US005392536A

United States Patent [19]

Perrissoud et al.

[11] Patent Number: 5,392,536

[45] Date of Patent: Feb. 28, 1995

[54] ALPINE SKI BOOT HAVING A FOOT RETENTION APPARATUS

[75] Inventors: Claude Perrissoud, Saint-Jorioz; Serge Lagier, Rumilly, both of France

[73] Assignee: Salomon S.A., Annecy Cedex, France

[21] Appl. No.: 645,643

[22] Filed: Jan. 25, 1991

[30] Foreign Application Priority Data

Jan. 26, 1990 [FR] France ..... 90 01103

[51] Int. Cl.[6] ..... A43B 5/04

[52] U.S. Cl. ..... 36/119; 36/117

[58] Field of Search ..... 36/117, 118, 119, 120, 36/121, 50.5

[56] References Cited

U.S. PATENT DOCUMENTS

| | | | |
|---|---|---|---|
| 4,083,129 | 4/1978 | Collombin et al. | 36/117 |
| 4,160,332 | 7/1979 | Salomon | 36/119 |
| 4,190,970 | 3/1980 | Annovi | 36/50.5 |
| 4,381,613 | 5/1983 | Lederer | 36/121 |
| 4,583,306 | 4/1986 | Paris | 36/119 |
| 4,769,929 | 9/1988 | Sartor | 36/117 |
| 4,922,633 | 5/1990 | Sartor | 36/117 |
| 4,937,952 | 7/1990 | Ollivieri | 36/117 Y |

FOREIGN PATENT DOCUMENTS

| | | |
|---|---|---|
| 2345097 | 10/1977 | France . |
| 2473856 | 7/1981 | France . |
| 2553634 | 4/1985 | France . |
| 1802710 | 5/1970 | Germany . |

*Primary Examiner*—Paul T. Sewell
*Assistant Examiner*—BethAnne Cicconi
*Attorney, Agent, or Firm*—Sandler, Greenblum & Bernstein

[57] ABSTRACT

The invention relates to an alpine ski boot provided with a foot retention apparatus which cooperates with at least one movable portion of said ski boot adapted to be applied against the front upper zone of the foot by means of a traction element directed obliquely towards the heel of the boot.

The boot is characterized in that it comprises an adjustment means for adjusting the obliqueness of the linkage with respect to the movable portion of the boot in correspondence with the front upper zone of the foot. This adjustment means has a plurality of conduits for guiding linkage 12 defining, respectively, a different obliqueness than the linkage, itself causing a different direction of the resultant F of the pressure forces exerted on the foot.

23 Claims, 5 Drawing Sheets

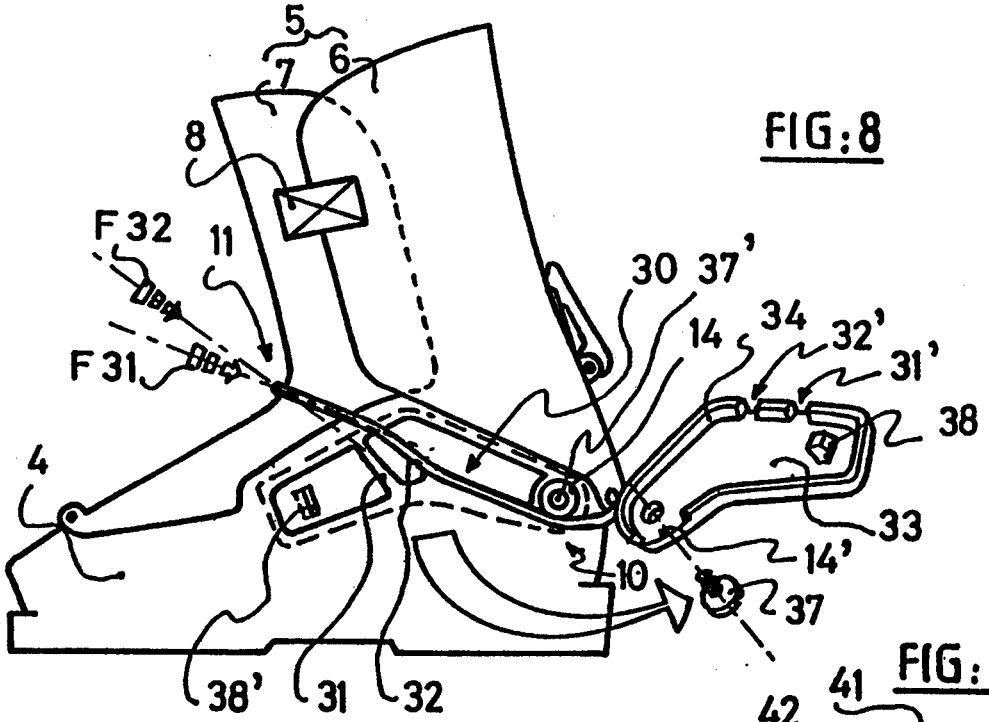
FIG:8
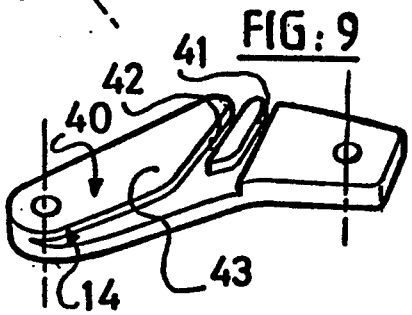
FIG:9
FIG:11
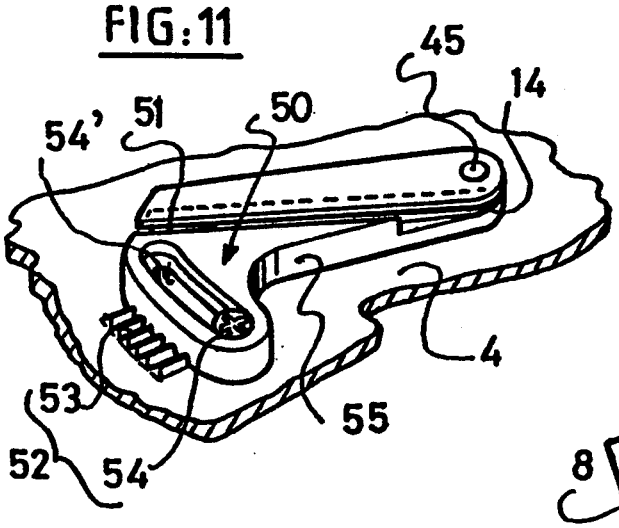
FIG:10
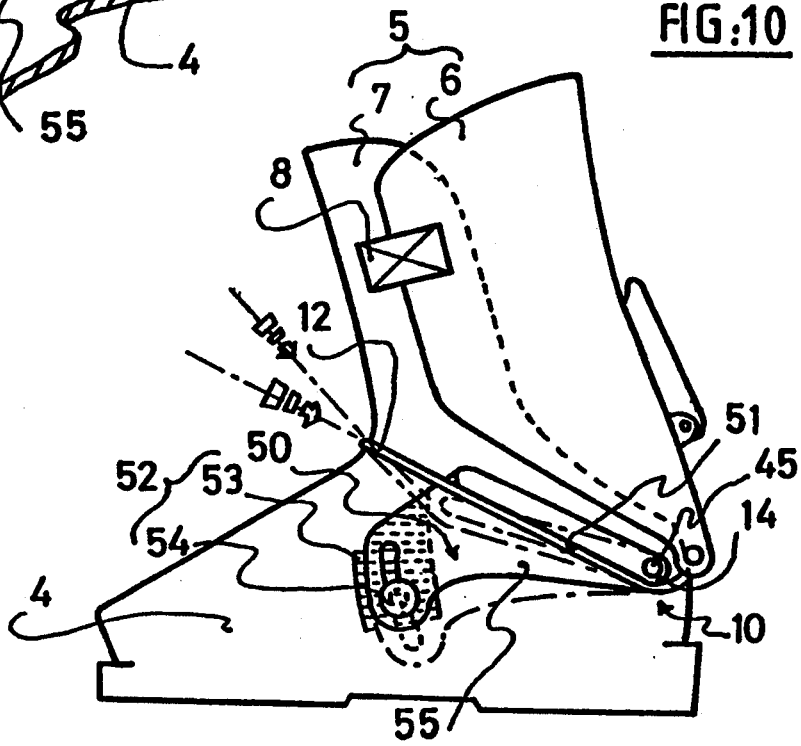

FIG: 12
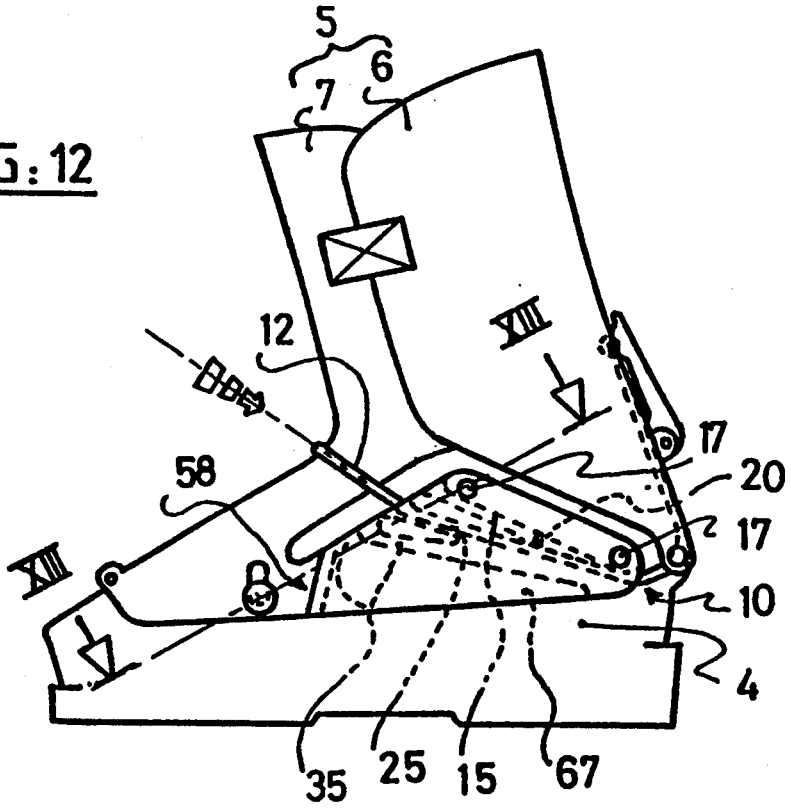
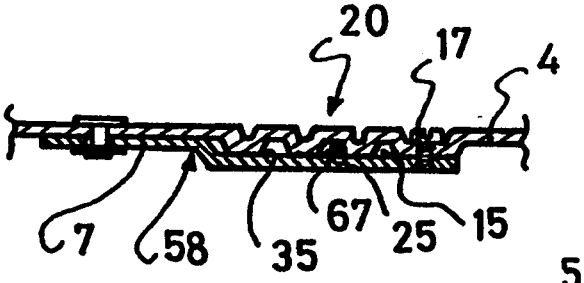
FIG: 13
FIG: 14
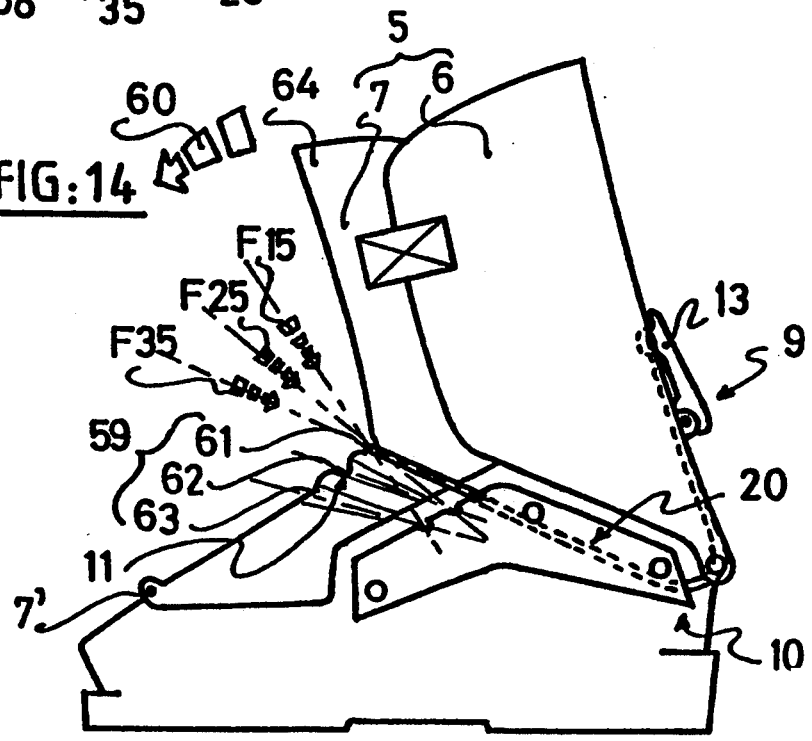

ALPINE SKI BOOT HAVING A FOOT RETENTION APPARATUS

BACKGROUND OF THE INVENTION

1. Field of the Invention

The present invention relates to alpine ski boots having a shell base capped by an upper, the upper being made of one or two portions, which are at least partially journalled for frontward-rearward movement with respect to the shell base. It relates in particular to boots of this type which are provided with a foot retention apparatus in the boot of the type exerting a tightening force on the front upper portion of the foot in an oblique direction going towards the heel.

2. Description of Background and Relevant Information

Ski boots of the type described above are known and in particular are described in published French Patent Applications 2,345,097 and 2,553,634, the disclosures of which are hereby incorporated by reference thereto.

In French Patent 2,345,097, guidance means are taught which are provided on the boot to orient the direction of traction of the cable of the foot retention apparatus. As will appear clearly from the description which is given, these guidance means are affixed and/or oriented to remain on the portion of the boot on which they are situated for one and only one direction of traction of the cable. It appears that this unique positioning of the guidance means is not able to satisfy different foot shapes by virtue of the fact that it is the direction of traction of the cable which determines the pressure zones which are exerted on the foot. Yet, sensitive points of the foot such as the instep and the flexion fold are moreover locations which are very variable in position from one foot to the other depending upon whether the foot is of the "hollow", "normal", or "flat" type for example.

French Patent 2,553,634 correctly proposes a particular construction of a boot of the same type but provided with pressure distribution plates making it possible to adapt themselves to all of the foot morphologies of the skiers at the level of the flexion fold and in particular to suppress the point or linear contact regions. In this boot construction, if the tractional force of the cable is distributed over the plates which cover the corresponding zone of the flexion fold of the foot, it is the direction of traction of the cable which remains determinative for the resultant of the pressure forces exerted on the foot, which, as a result, is subjected to a dominant pressure zone of constant direction.

SUMMARY OF THE INVENTION

The present invention has an aim to allow for the precise adjustment of the direction of the forces which are exerted on the foot in the zone which extends from the instep to the flexion fold as a function of the morphology of the foot of the skier and/or of a preferred portion of the foot which is subjected to these forces. Another aim is to offer a plurality of adjustment positions which are predetermined, of the direction of these forces from the initial adjustment position.

The ski boot according to the invention comprises a foot retention apparatus which cooperates with at least a deformable or displaceable portion of the boot subjected to displacement in a direction of the foot, particularly on the front upper zone of the foot extending from the instep to the flexion fold, by means of a traction element which begins from the heel and extends obliquely until the upper front zone of the foot on which it exerts, by means of the deformable or displaceable portion of the boot, a force directed substantially in the same direction as itself. The invention comprises interposing between the heel and the portion of the boot subjected to the action of the tractional element, on the front upper zone of the foot, an obliqueness adjustment means for adjusting the obliqueness of the element with respect to this portion of the boot. This adjustment means serves to alter the trajectory of the traction element in the proximity of the portion of the boot subjected to the traction element and in particular to give it a predetermined direction capable of inducing a resultant of the pressure forces adapted to the morphology of the foot of the skier, in particular in a position of the instep and/or the flexion fold.

According to a preferred embodiment, the foot retention apparatus has at least one tractional element which goes around and is supported on the portion of the boot which it covers towards the foot by means of a stretching lever positioned at the rear of the boot and to which it is connected by its lateral ends which extend obliquely on the sides of the said boot until the heel across guidance channels or conduits provided in the thickness of the constituent walls of the lateral surfaces of the boot.

BRIEF DESCRIPTION OF THE DRAWINGS

The characteristics of the boot according to the invention will be better understood which reference to the annexed description and drawings given by way of non-limiting example only, of a plurality of embodiments of the invention, in which:

FIGS. 8 and 9 illustrate other embodiments of another adjustment means constituted by an orientation and maintenance plate comprising two predetermined adjustments of the obliqueness of the tractional element;

FIGS. 10 and 11 illustrate an alternative embodiment of the means for adjusting the obliqueness of the tractional element, in which this adjustment means is constituted by an orientation and maintenance plate which is adjustable in position relative to the shell base of the boot;

FIGS. 12 and 13 illustrate a construction of the boot according to which the upper comprises a lateral extension which extends from each side of the shell base, which constitutes the maintenance plate of the adjustment means provided in the wall of the shell base;

FIG. 14 illustrates another construction of the boot in which the adjustment of the obliqueness of the tractional element likewise intervenes with respect to the control means of the flexion of the front portion of the upper in the rear-front direction;

DESCRIPTION OF PREFERRED EMBODIMENTS

Figure 1:
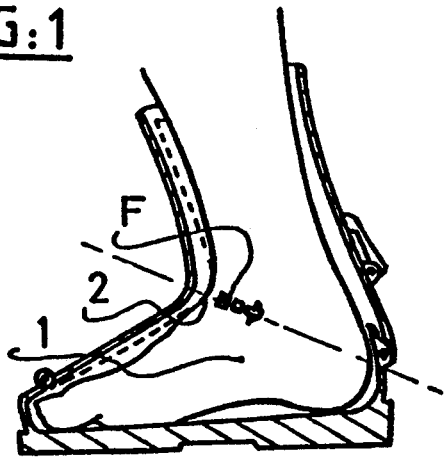
FIGS. 1–3 schematically illustrate the most common foot shapes, and respectively, the direction of the resultant of the pressure forces of a foot retention apparatus with respect to the position of the flexion fold.
Figure 2:
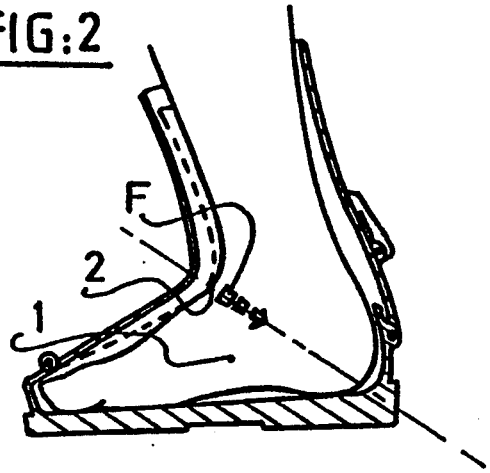
Figure 3:
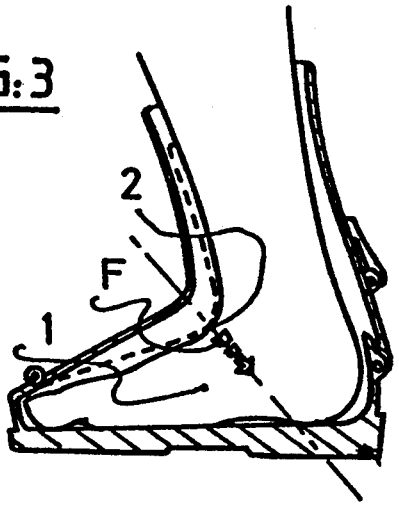

As previously explained, it is known that for a given length of the foot, the relative position of the instep and of the flexion fold varies depending upon whether the foot is more or less "hollow". In FIGS. 1–3, three different foot profiles 1 are shown schematically as well as their approximate positioning in a ski boot to show these variations in position. It is seen that these variations require an adjustment of the direction of the resultant force F of the pressure forces of a foot retention apparatus to respect the relative position of the flexion fold 2. Thus, in the example of FIG. 1, where the foot shown is a foot of the "hollow" type, the resultant force F is relatively less oblique in the direction of the heel; on the other hand, in the case of a foot of the "normal" type, FIG. 2, it is seen that this resultant force F must be more oblique with respect to the flexion fold of the foot 2. Likewise, as illustrated in FIG. 3, where the foot is of the "flat" type, it appears that this obliqueness of the resultant force F must be further accentuated.

Figure 4:
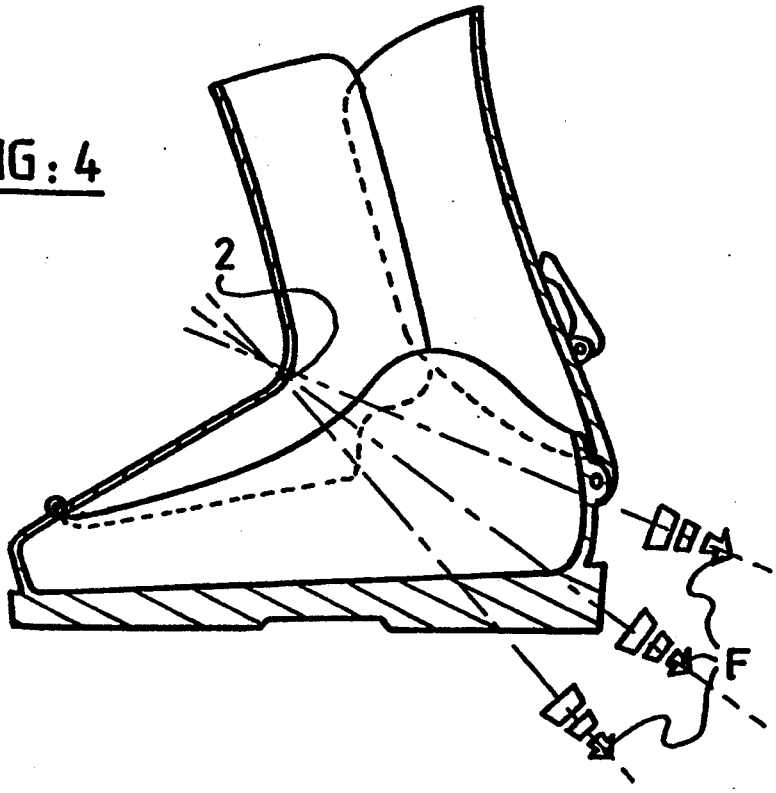
FIG. 4 schematically illustrates on a single boot, the preferred directions of the pressure forces to be applied with respect to the foot profile shown in FIGS. 1–3.

One thus sees in FIG. 4 on the preceding basis of the three types of feet taken as examples, that it is desirable to be able to obtain, with respect to the foot retention apparatus, three preferred directions of the resultant force F of the pressure forces to be exerted towards the foot to accept and hold these three types of feet in a boot under optimum conditions. Likewise, it becomes clear that for other types of feet, it would be preferable to be able to vary conjointly with these other types of feet the direction of the resultant force F. This is exactly what the invention proposes by associating with the apparatus for holding the foot a means for adjustment which is adapted to vary this resultant force F.

Figure 5:
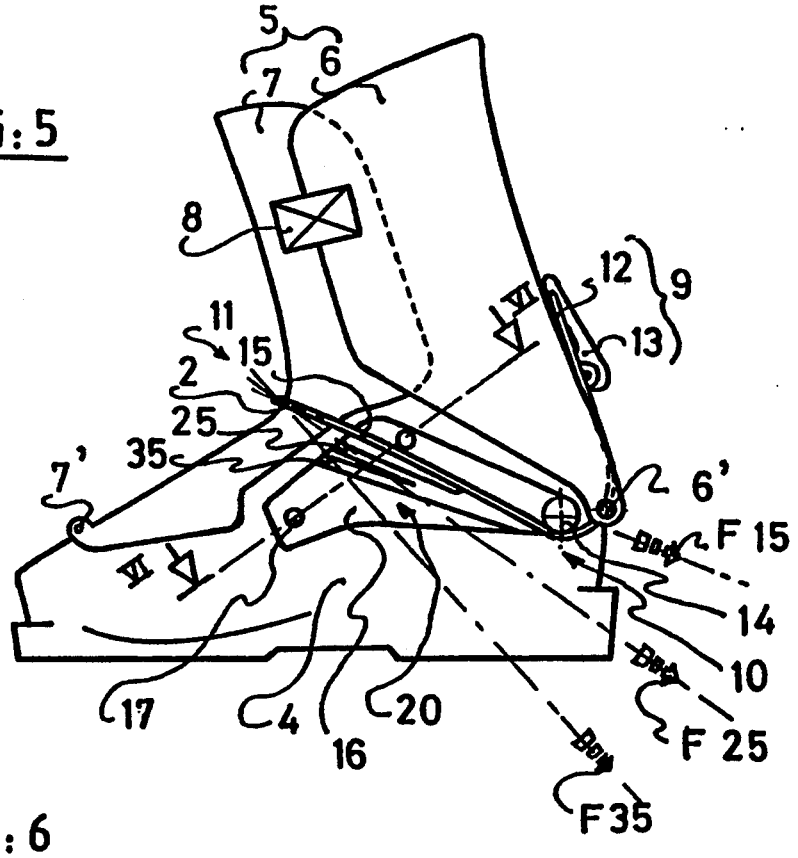
FIGS. 5 and 6 represent a ski boot comprising a foot retention apparatus whose tractional element is positioned in a means for adjusting the orientation of the tightening force, the said adjustment means being constituted by guidance channels provided in the wall itself of the shell base and covered by a plate, FIG. 6 being one view in partial cross-section along VI—VI of the boot of FIG. 5 illustrating a detail of the means for adjusting the obliqueness of the tractional element.

A first embodiment of a ski boot comprising a foot retention apparatus provided with such an adjustment means is shown in FIG. 5. In this example, the boot has a shell base 4 capped by an upper 5 constituted by a rear spoiler 6 and by a front cuff or spoiler 7 which are journalled mounted at 6', 7' on shell base 4 and are connected between themselves by known means 8 referred to as "closure" means of upper 5. These closure means 8 such as latches, cable stretchers, etc., assure the retention of the lower leg of the skier in the boot in the area of the upper 5 of the boot while a foot retention apparatus 9 extending from the front upper portion 11 of the foot to the rear spoiler 6 passing through the zone of heel 10 assures the retention itself of the foot in the boot, immobilizing the foot on the internal sole (not shown). This foot retention-apparatus 9 has a traction element or tightening connection cable or linkage 12 which goes around and is supported on the front cuff or spoiler 7 of the boot, in correspondence with the front upper zone 11 of the foot. This linkage 12, through its two lateral ends extending on each side of the front cuff 7, is then directed obliquely towards a guide 14 in the area of heel 10 and rises to rear spoiler 6 where it is connected to a stretcher lever 13. Thus, by tensioning linkage 12 by means of lever 13, upper 5 of the boot being closed, the front cuff 7, in its portion which corresponds with zone 11, undergoes the tractional force of linkage 12 and is displaced towards the foot substantially in the same direction as that of the tractional force which is determined by the general oblique direction of linkage 12 between its support on the front cuff 7 and its guide 14 in the area of heel 10. According to the invention, an adjustment means 20 for the obliqueness of linkage 12 is positioned on the side of shell base 4 between the front cuff 7 and the return element. 14 of linkage 12 at the level of heel 10.

In this embodiment, this adjustment means 20 is provided with three possibilities of oblique adjustment of linkage 12 corresponding to the three types of foot morphology previously described with reference to FIGS. 1–4. These adjustment possibilities are shown by three conduits 15, 25 and 35 for guidance of linkage 12 which extend on shell base 4 until the vicinity of front cuff 7 in correspondence with the upper front portion 11 of the foot, and even preferably in the vicinity of flexion fold 2 of the latter. These conduits 15, 25 and 35 are affixed in position and in diverging directions among them from guide 14 extend towards zone 11 until they intersect respectively therewith, correspondingly, the three directions F15, F25, F35 of the resultant force F of the pressure forces exerted towards the foot. The linkage 12 is thus deviated from its trajectory between its guide 14 and the zone 11 which is the front upper of the foot and exerts a tractional force directed substantially in the same direction as its obliqueness with respect to this zone. Depending upon the desired adjustment, linkage 12 is then placed in one of conduits 15, 25 and 35 which determine the corresponding resultant direction F15, F25, F35. As is visible in FIG. 6, conduits 15, 25 and 35 are obtained in the thickness itself of the wall of the shell base 4 and are closed towards the exterior by a maintenance and covering plate 16 which is retained by removable affixation means 17, such as for example screws, which render the means removable to allow for the mounting of linkage 12 in one of the conduits. In a preferred manner, the removable affixation means 17 are mounted from the interior of the boot and are retracted from the exterior surface of the cover plate 16. Thus, this plate 16, while assuring the retention of linkage 12 in the conduit 15, 25 or 35 which receives it, likewise protects the side of the boot in the zone corresponding to the adjustment means 20 which it covers. It is of course to be understood that, for protection, plate 16 is preferably adapted to at least partially project on the side of the boot with respect to the other constituent portions of the latter which extend in proximity. Furthermore, still for a better resistance to being hit by the edges for example, plate 16 can be made out of a relatively resistant material and/or comprise a highly resilient wear surface or having a coating of a material highly resistant to abrasion. Still according to the invention, in FIG. 7, the adjusting means 20 is positioned on a ski boot which comprises a foot retention apparatus 9 analogous to that previously described with reference to FIG. 5 but, in which the foot retention apparatus acts on a distribution plate 26 of the boot positioned within the boot to correspond with the front upper zone 11 of the foot and displaceable against the front upper zone. In such an embodiment, front cuff 7 is then preferably affixed in position with respect to shell base 4, and may possibly be made out of one piece therewith. As previously, the retention of the lower leg is assured with respect to the upper 5 by bringing together a rear spoiler 6 on front cuff 7 and the internal retention of the foot in the boot is assured by the application of the distribution plate 26 on the foot subjected to the tractional force of the linkage 12 controlled by the tensioning apparatus 9. An elongated opening 27 is then provided in shell base 4, facing guide conduits 15, 25 and 35 such that the linkage 12 can exert its force on plate 26.

As has been explained, it is desirable to provide the ski boot with several possibilities with adjusting the obliqueness of tightening linkage 12. However, for reasons of simplicity of design or convention, for example, it may be advantageous to provide only two possibilities of adjustment. Thus FIG. 8 illustrates a ski boot comprising an adjustment means 30 having only two conduits 31 and 32 adapted to induce resultant pressure forces exerted on zone 11 of the foot in the directions F31 and F32. It will be noted that the deviation of linkage 12 is achieved by means of conduits 31 and 32 which are substantially parallel to one another and not centered on guide 14, while conduits 15, 25 and 35 of the preceding adjustment means 20 converge and are centered on the return element 14. In fact, the guide conduits can be oriented as desired and have various trajectories depending upon the modification needs of the obliqueness of linkage 12 with respect to the front upper zone 11 of the foot and, thus, with respect to the portion of the boot which it secures against the latter when it is tensioned.

Figure 6:
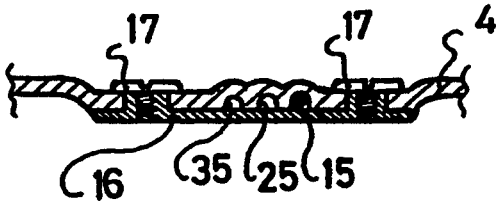
Figure 7:
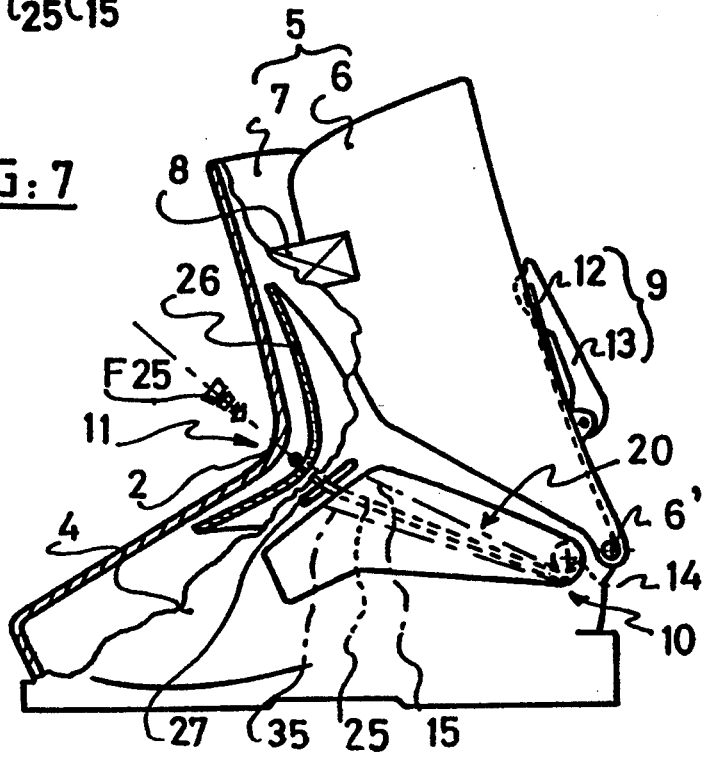
FIG. 7 illustrates, in schematic cross-section, a foot retention apparatus analogous to that of FIG. 5 but acting on an internal portion of the boot, which is displaceable in the direction of the foot of the skier.

In the embodiment of the adjustment means 30, the constructive arrangement of the latter includes a cover plate 33 whose function is analogous to that of plate 16 described in FIGS. 5 and 6, and has a nesting edge 34 on the zone of the periphery of the conduits, and is as a result formed with cut outs 31', 32' and 14' coinciding with the trajectory of linkage 12 at the level of its guide 14 and at the level of its conduit outlet 31 and 32. Furthermore, this plate 33 is retained on the wall of shell base 4 by removable affixation means such as a screw 37 and a latch 38 cooperating respectively with a tapped hole 37', and a cutout 38'.

According to another embodiment of the invention, FIG. 9, an adjustment means 40 is constituted out of a removable element or maintenance and orientation plate 43 positioned on the side of the boot by removable affixation means of a known type. In such an embodiment, guidance conduits 41 and 42 are then provided in the thickness of this plate 43 and the shell base 4 no longer has the corresponding means provided to the affixation means. Preferably, the return element 14 can likewise be provided directly on orientation plate 43 of adjustments 40.

Furthermore, the relative position of the maintenance and orientation plate of the adjustment means of the orientation of a traction element can itself be modified with respect to the shell base. Thus, in the embodiment of the boot shown in FIG. 10, the adjustment means 50 is constituted by a maintenance plate 50 of a certain thickness comprising a single guidance conduit 51 and adjustment elements 52 of its position on shell base 4. This plate 55 (FIGS. 10 and 11) is connected in a pivotable manner on shell base 4 in the area of the return element 14 in the zone of the heel 10 and is adjustable depending upon the angular position selected from the return 14 through elements 52. These are constituted by a succession of teeth 53 provided in a complementary fashion on the wall of shell base 4 and on the corresponding surface of element 55, as well as an assembly screw 54 cooperating with the shell base across on oblong slot 54' which is concentric to linkage and pivot axis 45 of plate 55. Thus, such a construction makes it possible to vary, and even to adapt with precision the obliqueness of linkage 12 with respect to the front upper zone 11 of the foot and, conjointly, the direction of the resultant force F of the pressure forces being exerted on this zone. It is evident that the precision of adjustment of the obliqueness of linkage 12 depends on the nature of adjustment elements 52, in particular the spacing (or "path") of the teeth 53. Other solutions may be envisaged so as to improve this precision by utilizing in place of the preceding tooth system micrometric adjustment elements of the screw and tooth type for example.

According to another embodiment of the invention, shown in FIGS. 12 and 13, the plate for maintaining and covering adjustment means 20 is constituted by a rearward extension 67 of front cuff 7 of the boot covering the guide conduits 15, 25 and 35 provided in the shell base. This extension 67 has flexibility characteristics and/or a flexible zone 58 which renders it adapted to be spaced from the guide conduits 15, 25 and 35 to access to the linkage 12 and proceed to the positioning of the latter in the conduit selected. The retention of the extension 67 on the side of the boot after adjustment of the position of the linkage 12 is achieved by the means of removable affixation means 17 preferably mounted from the interior of the boot so as not to project on the extension 67 on the exterior side of the boot.

It is self evident that the adjustment means 20 according to the invention can likewise cooperate with the opening means to control the flexion of the upper 5. By way of example, in FIG. 14, the front cuff 7 is formed out of one flexion zone 59 which elastically opposes the front-rear movements to which it is subjected during the frontward flexion of upper 5 of the boot, such as along arrow 60. The flexible zone 59 comprises grooves 61, 62 and 63, each adapted to receive, respectively, linkage 12. Thus, when linkage 12 is tensioned by means of foot tensioning apparatus 9, cuff 7 is, on the one hand, pressed against the front upper portion 11 of the foot and, on the other hand, retained from any frontward movement from its zone 59 and/or around its journal 7'. As is shown, grooves 61, 62 and 63 are spaced progressively from the upper edge 64 of front cuff 7 where the lower leg of the skier is supported. Thus, depending upon whether linkage 12 is engaged in groove 61 which is closest or 63 which is most spaced from the upper edge 64 of the front cuff, the retention conditions of the latter vary and, intrinsically, the value of its resistance to flexion towards the front indicated by the arrow 60. It will be noted that, for each position of linkage 12 in the one or more grooves 61, 62 or 63, one always has as many possibilities of adjustment of obliqueness of linkage 12.

Figure 15:
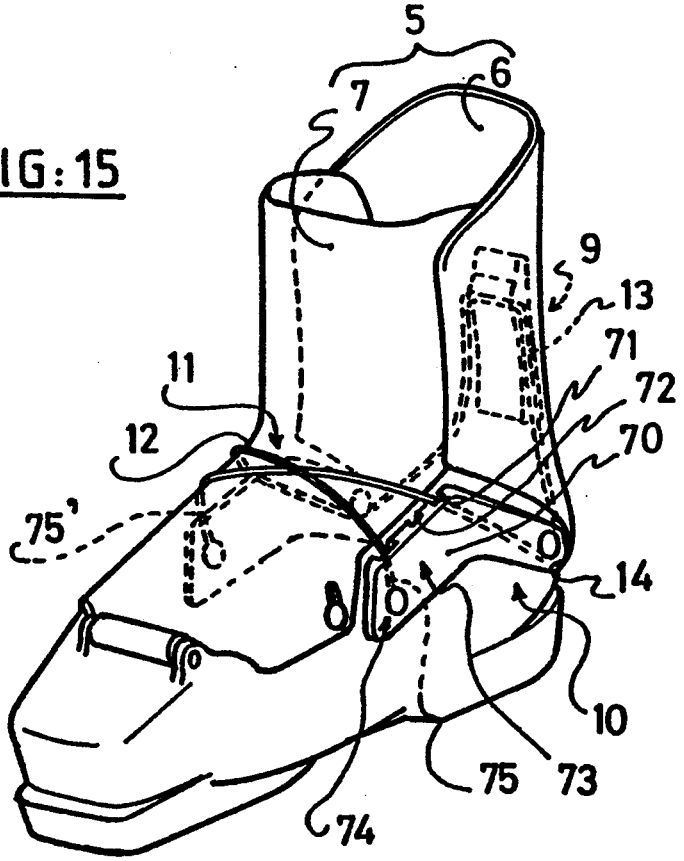
FIG. 15 illustrates one embodiment of a boot according to the invention whose plate for maintaining the traction element constitutes likewise the anchorage point of one end of the traction element.

Furthermore, in FIG. 15, the adjustment 70 constituted by an adjustment plate 73 can likewise be provided with an anchorage point 74 of one of the ends 75, 75' of linkage 12. In this embodiment, linkage 12 extends diagonally above front cuff 7 in correspondence with zone 11 of the foot, is guided as desired in one or more conduits 71 and 72, goes around return 14 and rises until stretcher lever 13. From stretcher lever 13, linkage 12 extends to the other side of the boot where it travels a symmetrical (preferably) crossing path into the zone 11 on front cuff 7.

Figure 16:
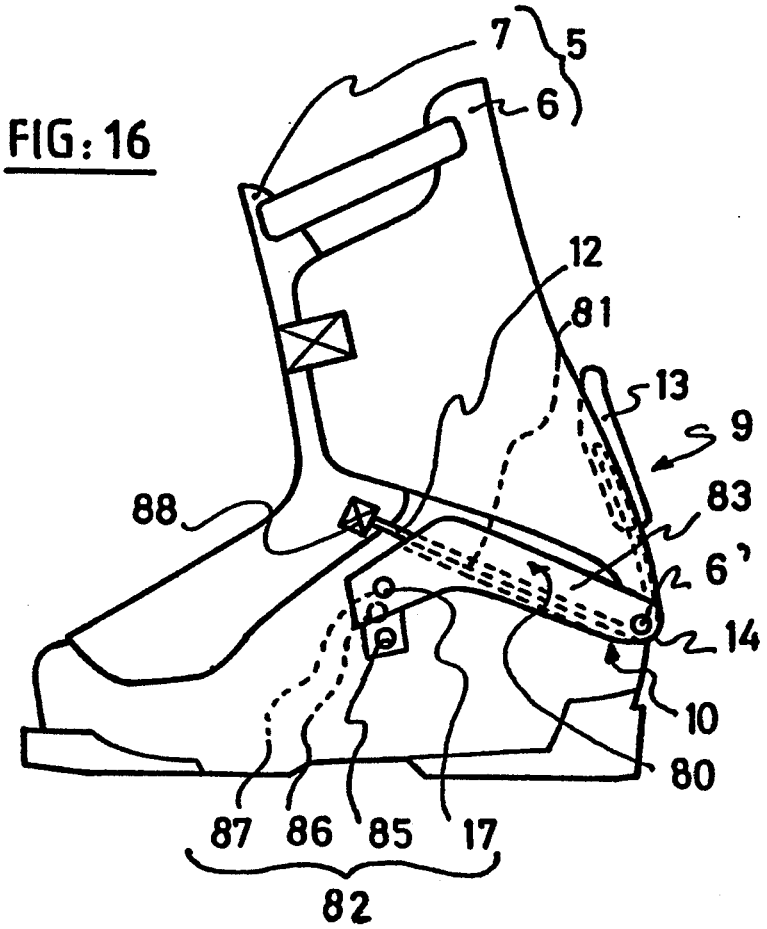
FIG. 16 illustrates an alternative embodiment of the invention in which the maintenance plate is connected to the shell base on the journal axis of the rear spoiler of the boot.

In FIG. 16, there is shown an adjustment means 80 for adjusting the obliqueness for linkage 12 equivalent to that described with FIGS. 10 and 11 in which the adjustment means is connected in the pivotable manner on shell base 4 by means of journal 6' of the rear spoiler. Linkage 12 passes in a unique conduit 81 and a return element 14 is then assimilated and/or coincides with journal 6'. Furthermore, adjustment elements 82 of the relative position of means 80 with respect to the shell base differentiate themselves from those at 52 in that they are constituted by a succession of three linkage points 85, 86 and 87 positioned in the wall of the shell base concentrically with the journal 6' and with which cooperate a removable affixation means 17.

It is evident that the invention is not limited to the construction examples which have just been described and that the foot retention apparatus 9 in particular can be of a different type, even comprise a tensioning means of linkage 12 other than a stretcher lever 13, for example, a windup roller. Likewise, the means for tensioning linkage 12 can furthermore be situated not only on rear spoiler 6 as long as linkage 12 is made oblique on the portion of the boot which it secures in the direction of the front upper zone 11 of the foot.

This application claims the priority of French Application 90.01103 dated Jan. 26, 1990, the disclosure of which is hereby incorporated by reference thereto.

Finally, although the invention has been described with reference to particular means, materials and embodiments, it is to be understood that the invention is not limited to the particulars disclosed and extends to all preference within the scope of the claims.

What is claimed is:

1. A ski boot comprising:

a shell base;

an upper, said upper comprising a rear spoiler journalled on the shell base, and a front cuff;

closure means for the upper;

a foot retention apparatus, said foot retention apparatus comprising (i) a traction element and (ii) means for tensioning said traction element, said means for tensioning being positioned on the rear spoiler; and means for enabling adjustment of the foot retention apparatus comprising means for maintaining said traction element in any of a plurality of discrete trajectories, in which said traction element extends between an area of the heel of the foot and an area of the top of the foot, said means for maintaining said traction element in any of a plurality of discrete trajectories comprising at least one guide for guiding a portion of said traction element, said at least one guide being positioned laterally on said shell base, wherein said means for maintaining said traction element in any of a plurality of discrete trajectories comprises a maintenance plate for maintaining said traction element in said at least one guide.

2. A ski boot as defined by claim 1, wherein said means for maintaining said traction element in any of a plurality of discrete trajectories comprises a maintenance plate, said maintenance plate having a thickness within which a plurality of guides are provided, and means for enabling movement of said maintenance plate with respect to said shell base.

3. A ski boot as defined by claim 1, further comprising a lateral extension extending from said front cuff, and wherein said maintenance plate is constituted by said lateral extension.

4. A ski boot as defined by claim 3, wherein said lateral extension is connected to said front cuff at a flexible junction zone for accommodating flexion of the boot during skiing.

5. A ski boot as defined by claim 1, wherein said means for maintaining said traction element in any of a plurality of discrete trajectories comprises at least two guides, said at least two guides extending at an angle along different directions from the heel area.

6. A ski boot as defined by claim 1, wherein said maintenance plate is journalled about an axis at a rear portion of said maintenance plate with respect to said shell base, said means for enabling adjustment comprising means for securing said maintenance plate in any of a plurality of angular positions with respect to said shell base, said means for securing said maintenance plate being located in front of said axis.

7. A ski boot as defined by claim 6, wherein said means for securing said maintenance plate comprises an assembly of teeth on said maintenance plate and a complementary assembly of teeth on a surface of said shell base for engagement therewith, an oblong slot provided in a forward portion of said maintenance plate and a removable attachment element extending within said oblong slot, said removable attachment element comprising means for selectively securing said maintenance plate in position against said shell base.

8. A ski boot as defined by claim 2, wherein said traction element comprises a cable, and wherein each of said guides has a dimension at least equal to that of the cable.

9. A ski boot as defined by claim 1, wherein the traction element extends from one lateral side of the boot to an opposite lateral side of the boot.

10. A ski boot as defined by claim 9, wherein said means for maintaining said traction element in any of a plurality of discrete trajectories further comprises, on a front portion of the front cuff in a zone of the boot corresponding to the instep of the foot, means for positioning said traction element in any of a plurality of positions at said front portion of said front cuff.

11. A ski boot as defined by claim 1, further comprising an attachment point on each lateral side of a front portion of the boot for attachment to said traction element.

12. A ski boot as defined by claim 1, wherein said means for maintaining said traction element in any of a plurality of discrete trajectories comprises an adjustment plate, on each lateral side of the boot, for maintaining said traction element in said at least one guide, wherein said traction element comprises two cable portions, said two cable portions crossing over a front portion of the boot and having respective ends, each of said respective ends having an attachment point on a respective one of said adjustment plates.

13. A ski boot as defined by claim 1, wherein said maintenance plate comprises a portion that at least partially projects from a side of the shell base, said maintenance plate comprising a material made of a wear-resistant material.

14. A ski boot as defined by claim 1, wherein said maintenance plate comprises a portion that at least partially projects from a side of the shell base, said maintenance plate having a coating of a material highly resistant to abrasion.

15. A ski boot as defined by claim 1, wherein said at least one guide comprises a guide positioned on each of opposite lateral sides of said shell base for guiding respective portions of said traction element on a respective lateral side of said shell base in respective ones of said discrete trajectories by means of said means for enabling adjustment of the foot retention apparatus.

16. A ski boot as defined by claim 1, wherein said means for maintaining said traction element in any of a plurality of discrete trajectories comprises means for maintaining said traction element in any of a plurality of discrete trajectories in said area of the top of the foot.

17. A ski boot comprising:

a shell base;

an upper, said upper comprising a rear spoiler journalled on the shell base, and a front cuff;

closure means for the upper;

a foot retention apparatus, said foot retention apparatus comprising (i) a traction element and (ii) means for tensioning said traction element, said means for tensioning being positioned on the rear spoiler; and means for enabling adjustment of the foot retention apparatus comprising means for maintaining said traction element in any of a plurality of discrete trajectories, in which said traction element extends between an area of the heel of the foot and an area of the top of the foot, said means for maintaining said traction element in any of a plurality of discrete trajectories comprising at least one guide for said traction element, said at least one guide being positioned laterally on said shell base, wherein said means for maintaining said traction element in any of a plurality of discrete trajectories comprises a plurality of guides formed in a lateral wall of said shell base, and a cover plate removably affixed to said lateral wall of said shell base for retaining said traction element within one of said plurality of guides.

18. A ski boot as defined by claim 17, wherein said traction element comprises a cable, and wherein each of said guides has a dimension at least equal to that of the cable.

19. A ski boot comprising:

a shell base;

an upper, said upper comprising a rear spoiler journalled on the shell base, and a front cuff;

a foot retention apparatus, said foot retention apparatus comprising (i) a traction element, the traction element having a trajectory extending around a top portion of a foot and extending to a heel area of the foot, when the foot is inserted within the boot, and (ii) a tensioning apparatus for tensioning the traction element; and an apparatus for enabling adjustment of the trajectory of said traction element comprising at least one guide for said traction element, said at least one guide being positioned laterally of said shell base, wherein said traction element extends over the top of the foot exteriorly of the shell base, and wherein said at least one guide comprises means for adjusting said trajectory of said traction element to assume any of a plurality of predetermined fixed trajectories of said traction element at opposite lateral sides of said shell base.

20. A ski boot according to claim 19, wherein said at least one traction element extends over the top of the foot within said shell base.

21. A ski boot as defined by claim 19, wherein said apparatus for enabling adjustment of the trajectory of said traction element comprises means for enabling selective adjustment of the trajectory of said traction element around said top portion of the foot.

22. A ski boot comprising:

a shell base;

an upper, said upper comprising a rear spoiler journalled on the shell base, and a front cuff;

closure means for the upper;

a foot retention apparatus, said foot retention apparatus comprising (i) a tightening linkage having a portion extending in a downward and rearward trajectory at a lateral side of the foot, and (ii) means for tensioning said tightening linkage and for applying a retention force to the foot, said means for tensioning being positioned on the rear spoiler;

a guide for guiding said tightening linkage in said predetermined trajectory extending downwardly and rearwardly on a lateral side of the foot; and means for facilitating a changing of said downward and reward trajectory of said tightening linkage at said lateral side of the foot to a different trajectory and for guiding said tightening linkage in said different trajectory.

23. A ski boot as defined by claim 22, further comprising a second guide, wherein said tightening linkage comprises a further portion guided by said second guide to extend in a downward and rearward trajectory at an opposite lateral side of the foot and wherein said tightening linkage extends over a top portion of a foot.

* * * * *